US007011271B2

(12) United States Patent
Walters

(10) Patent No.: US 7,011,271 B2
(45) Date of Patent: Mar. 14, 2006

(54) TOILET PAPER DISPENSER

(76) Inventor: Chad C. Walters, 16868 Cedar Creek La., Noblesville, IN (US) 46060

( * ) Notice: Subject to any disclaimer, the term of this patent is extended or adjusted under 35 U.S.C. 154(b) by 230 days.

(21) Appl. No.: 10/658,012

(22) Filed: Sep. 9, 2003

(65) Prior Publication Data

US 2005/0051663 A1 Mar. 10, 2005

(51) Int. Cl.
*B65H 49/32* (2006.01)

(52) U.S. Cl. ..... 242/598.5; 242/596.8

(58) Field of Classification Search ..... 242/560, 242/560.2, 596.8, 597.8, 598.5, 598.6; 312/242, 312/245, 34.1, 34.8, 34.22, 34.24; D6/518, D6/519, 520, 523, 55; 221/92, 123, 282; 211/86.01, 87.01; 248/905; 52/700; 411/456
See application file for complete search history.

(56) References Cited

U.S. PATENT DOCUMENTS

| | | | | | |
|---|---|---|---|---|---|
| 1,745,771 | A | * | 2/1930 | Sherwood | 242/595 |
| 2,487,763 | A | | 11/1949 | Patterson et al. | |
| 2,561,584 | A | | 7/1951 | McDonald | |
| 2,576,526 | A | * | 11/1951 | Marchand | 242/598.5 |
| D172,963 | S | * | 9/1954 | Glenn | D6/523 |
| 2,805,112 | A | * | 9/1957 | Krueger | 312/34.8 |
| 2,819,852 | A | | 1/1958 | Sarro | |
| D186,493 | S | * | 11/1959 | Sarro | D6/523 |
| 3,062,606 | A | * | 11/1962 | Magrauth | 312/34.24 |
| 3,171,135 | A | | 3/1965 | Polichio | |
| 3,239,295 | A | * | 3/1966 | Simon | 312/34.22 |
| 3,271,090 | A | * | 9/1966 | Smithers | 312/34.22 |
| 3,295,900 | A | * | 1/1967 | Kendall | 312/34.22 |
| 3,310,353 | A | | 3/1967 | Cordis | |
| 3,428,267 | A | | 2/1969 | Briles | |
| 3,494,518 | A | * | 2/1970 | Goss | 242/560 |
| 3,729,145 | A | | 4/1973 | Koo et al. | |
| 3,760,976 | A | * | 9/1973 | Andreacchio | 242/598.6 |
| D254,412 | S | * | 3/1980 | Knight | D6/523 |
| 4,191,317 | A | | 3/1980 | Harkins | |
| 4,285,474 | A | | 8/1981 | Perez | |
| 4,444,359 | A | * | 4/1984 | Butler | 242/598.6 |
| 5,377,866 | A | | 1/1995 | Watters, II | |
| 5,605,250 | A | | 2/1997 | Meiron et al. | |
| 5,653,403 | A | | 8/1997 | Ritchey | |
| 5,704,565 | A | | 1/1998 | Cheng | |
| D393,972 | S | * | 5/1998 | Kato | D6/523 |
| 5,878,893 | A | | 3/1999 | Micienko | |
| 5,893,531 | A | * | 4/1999 | Taylor et al. | 242/598.6 |
| 6,015,125 | A | * | 1/2000 | Fischer | 242/596.8 |
| 6,167,575 | B1 | | 1/2001 | Smith | |
| 6,202,956 | B1 | | 3/2001 | Grasso et al. | |
| 6,273,359 | B1 | | 8/2001 | Newman et al. | |
| 6,279,865 | B1 | | 8/2001 | Newman et al. | |
| 6,315,237 | B1 | * | 11/2001 | Hoerner | 242/560 |
| 6,328,253 | B1 | | 12/2001 | Paul | |
| 6,540,195 | B1 | | 4/2003 | Newman et al. | |

* cited by examiner

*Primary Examiner*—William A. Rivera
(74) *Attorney, Agent, or Firm*—Woodard, Emhardt, Moriarty, McNett & Henry, LLP

(57) ABSTRACT

An inventive toilet paper dispenser includes a dispenser body and an opening. A door is connected to the body and can selectively open and close the opening. A toilet paper roll holder is connected to the door and extends into the holder when the door is closed. A flange portion and a movable member extend from the body. As the body is advanced into a hole in a wall until the flange portion contacts the outside surface of the wall the member impinge into the wall.

22 Claims, 6 Drawing Sheets

TOILET PAPER DISPENSER

BACKGROUND

The present invention relates generally to new toilet paper holders and dispensers. More particularly, the present invention relates to new toilet paper dispensers and holders providing selectable accessibility and protection of rolls of toilet paper.

Toilet paper can be an attractive nuisance for children who would use it as a toy. Pets can also play with, chew or even eat toilet paper. Such mischief can be vexing, messy and wasteful. The present invention protects against such problems by providing for protection and access to toilet paper. The present invention brings such advantages, among others, to the do-it-yourselfer and professional alike by increasing simplicity and efficiency of installation and operation.

SUMMARY

One form of the present invention includes a new toilet paper dispenser having a body and an opening. A door is connected to the body and can selectively open and close the opening according to a user's desire. A toilet paper roll holder is connected to the door and extends into the holder when the door is closed. A flange portion and a rib member extend from the body. As the body is advanced into a hole in a wall until the flange portion contacts the outside surface of the wall the rib member impinges into the wall.

In other forms of the invention a hinge connects the door and the body to one another, the flange and the body are a unitary piece, the rib member impinging into the wall includes one of cutting and compression of the wall, the body and the moveable member are a unitary piece, upon the flange member contacting the outside surface of the wall, the flange member extends out from the outside surface of the wall a distance of at least about 1.1 inches.

In yet another form of the present invention, a toilet paper dispenser includes a container adapted to receive a roll of toilet paper. The container has an opening, a cover that opens and closes about the opening, a first diameter portion, and a second diameter portion with a greater diameter than the first. A fixture which is adapted to receive a roll of toilet paper is connected to the cover. A number of rib members are connected to the first diameter portion and can impinge into the wall when the first diameter portion is inserted into an opening in a wall. The dispenser can extend into the wall a maximum distance not more than about four inches upon the second diameter portion contacting the exterior surface of the wall.

In additional forms of the present invention, when the toilet paper roll is received by the fixture the toilet paper is contained in the container when the cover is closed and moved out of the container when the cover is open, the second diameter portion includes a flange surface which an extremity or terminus of the second diameter portion and/or can be curved outward from the opening when the cover closes about the opening. A first portion of the container can extend into the wall and a second portion of the container can extend out from the exterior surface of the wall when the first diameter portion is inserted into the opening in the wall and the second diameter portion contacts the exterior surface of the wall. The wall can be a standardized wall construction and the fixture can extend into the wall a distance not greater than that provided by the standardized wall construction.

In still further forms of the present invention, a toilet paper dispenser includes an opening, a front portion and a rear portion. The rear portion has a lesser circumference than the front portion allowing the rear portion to be inserted into a hole in a wall but preventing the front portion from being so inserted. A door is positioned to cover the opening in a closed position and is displaceable to travel outward from the opening. A toilet paper roll mounting member adapted to receive a roll of toilet paper is connected to the door. The rear portion can extend from the front portion to a terminus over a distance not greater than that of a standardized construction wall.

In additional forms of the present invention, the toilet paper dispenser includes a plurality of retaining members extending from the container and positioned such that when the rear portion is inserted into the hole in the wall and the front portion contacts the exterior surface of the wall the members impinge into the wall to maintain the dispenser in position relative to the wall. The front portion can include a flange, the door can be hinged to the dispenser, and when the mounting member receives a roll of toilet paper and the door is in the closed position the toilet paper extends from a position exterior to the wall to a position interior to the wall.

Further forms, embodiments, objects, features, advantages, benefits, and aspects of the present invention will be apparent from the drawings and descriptions provided herein.

DETAILED DESCRIPTION

Figure 1:
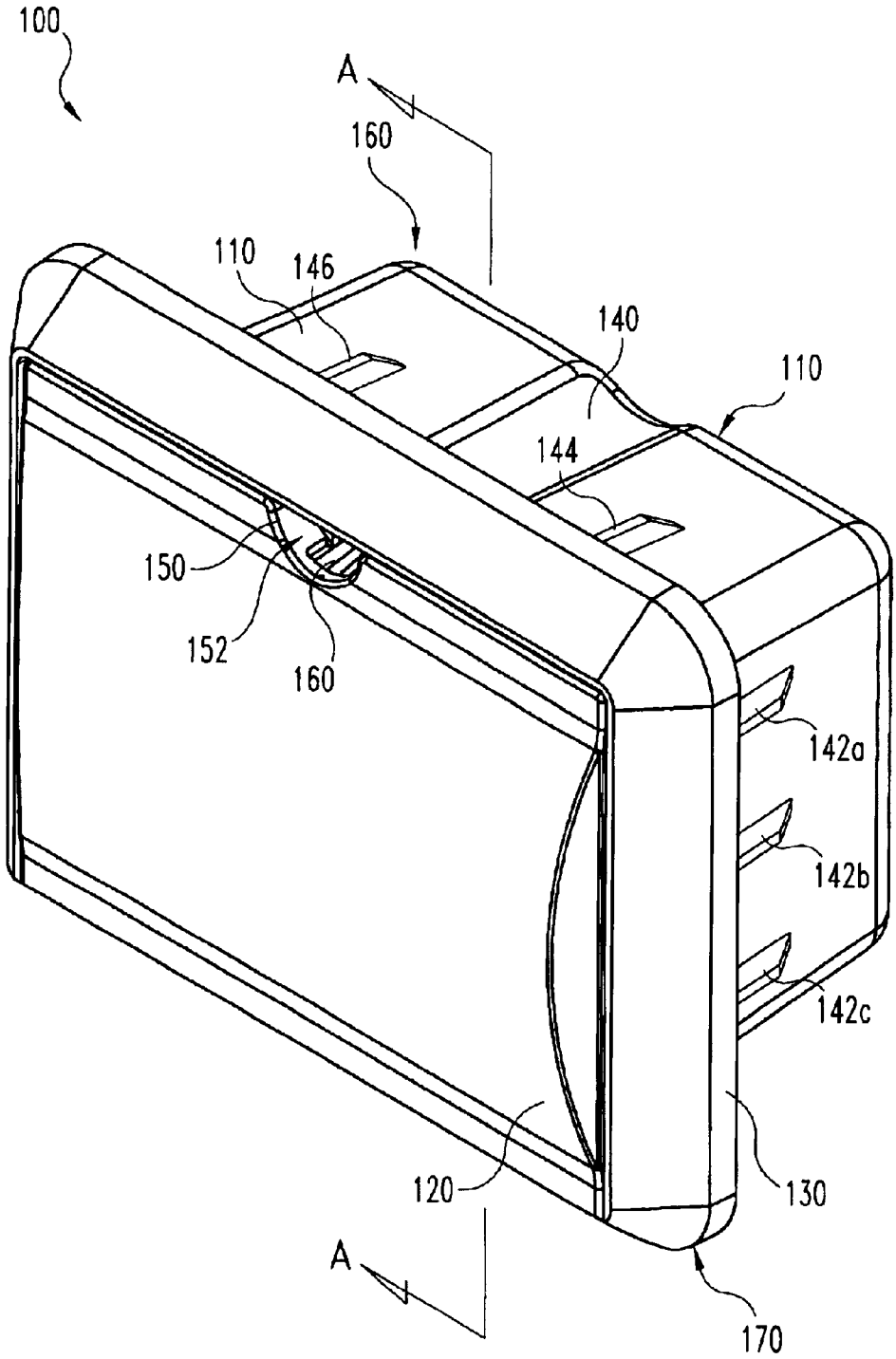
FIG. 1 is a perspective view of a toilet paper dispenser according to the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 shows a toiled paper holder 100 according to one embodiment of the present invention. Holder 100 includes body 110, door 120 and flange 130. FIG. 1 shows the holder 100 with the door in a closed configuration. In this configuration door 120 covers or closes an opening. In such a position holder 100 can contain and protect a roll of toilet paper, for example, as discussed below in connection with FIGS. 5 and 6.

Body 110 and flange 130 comprise a unitary piece. In other embodiments body 110 and flange 130 could be non-unitary pieces connected or attached by a great many techniques, methods, materials and/or combinations thereof including, as non-limiting examples, by fastening, gluing, fusing, mechanically connections and/or chemical bonds.

Door 120 is connected dispenser 100 with post hinges as further discussed below in connection with FIGS. 5 and 6. In further embodiments door 120 could be connected to holder 100 using other methods, for example, a reduced-thickness strip or using a variety of hinge hardware. Still further embodiments contemplate connecting the door toward a side or the top of holder 100 and/or using multi-piece door assemblies. Numerous other possible connections will be apparent to one of skill in the art.

Holder 100 also includes latch 160 that holds door 120 in the closed position until released. Cutaway 150 and opening 152 provide access to latch 160 and can be sized, for example, to permit one or two fingers to pass past door 120 in order to depress latch 160. Groove 140 of body 110 also permits similar access to the top of latch 160 on the opposite side of flange 130 and provides for the operation of latch 160 by allowing its movement without interference from body 110. Upon being actuated latch 160 allows door 120 to open to provide access to the toilet paper that may be contained in holder 110 and/or for installation and replacement purposes.

Holder 100 further includes rib members 142*a*, 142*b*, 142*c*, 144 and 146 and, as discussed below, other such members not illustrable in the present view. As holder 100 is inserted into a hole formed in a wall, the rib members can impinge into the wall, for example by cutting or compressing the wall. After installation, flange 130 contacts one side of the installation wall and extends out therefrom. As stated above, identical or similar rib members can be provided extending from portions of body 140 that are not visible in FIG. 1. Other embodiments contemplate varied placement and number of the same or similar members both relative to body 110 and to one another. For example, members 148, shown in FIGS. 2–4 and 149, shown in FIGS. 5–6 may be substantially the same as members 142*a*, 142*b*, 142*c*, 144 and 146, or varied as described above.

As shown in FIG. 1 members 142*a*, 142*b*, 142*c*, 144 and 146 are unitary to body 110. This can be accomplished by injection molding or cutting or a combination thereof. Other embodiments contemplate attaching rib members using, for example, the variety of exemplary techniques disclosed above in connection with discussion of body 110 and flange 130.

Body 110 includes front portion 170 and rear portion 160. As shown in FIG. 1, front portion 170 has a greater diameter and a greater circumference than rear portion 160. Such a configuration allows rear portion 160 to be inserted into an opening of appropriate size while preventing the insertion of front portion 170.

Figure 2:
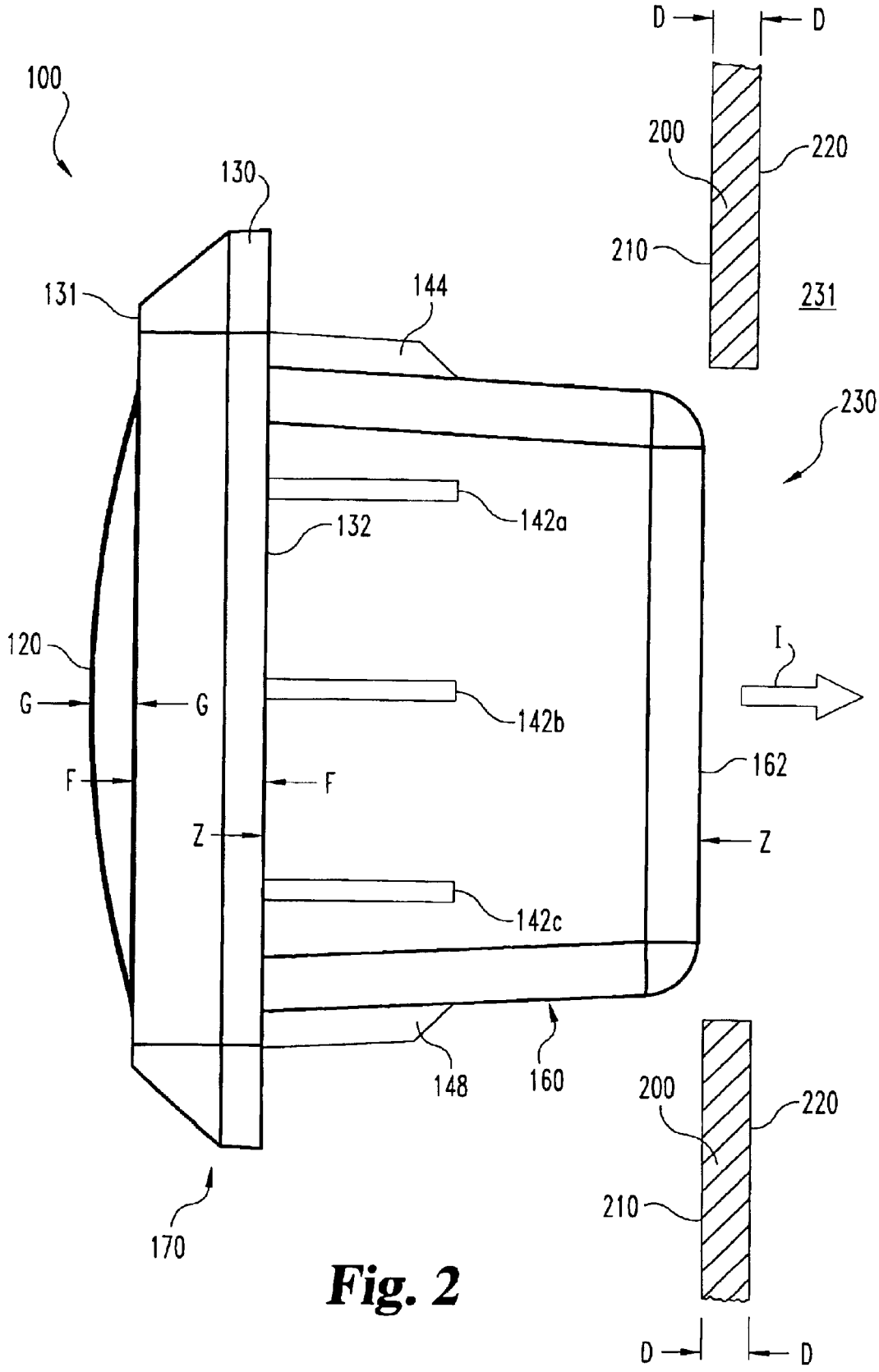
FIG. 2 is a first side view of a toilet paper dispenser according to the present invention and an environment including a wall.

FIG. 2 shows a side view of the holder 100 in an installation environment including wall 200 which is shown in cross section. Wall 200 includes exterior surface 210 and interior surface 220 and interior space 231. The environment further includes hole 230 formed in wall 200. Wall 200 has a thickness defined by the distance D—D between surfaces 210 and 220. Distance D—D can be about ¼ inch, ½ inch, or ⅝ inch such as, for example, in the case of standard drywall or sheetrock materials. However, distance D—D could be other standard distances of other wall materials or could be another distance in the case of other non-standard walls.

Various dimensions of holder 100 include distance Z—Z which is approximately four inches, distance F—F which is approximately 1.1 inches and distance G—G which is approximately 0.4 inches. The distances, Z—Z, F—F and G—G provide for the containment and selectable access of a conventional roll of toilet paper within the holder 100 and for the insertion of holder 100 into a standardized wall construction as described below.

FIG. 2 shows that holder 100 can be inserted in to hole 230 formed in wall 200 as indicated by arrow I. Rear portion 160 is sized to be insertable into hole 230. Front portion 170 is sized so as not to permit insertion into hole 230. Front portion 170 extends from surface 131 to surface 132 and rear portion 160 extends to surface 162. Distance Z—Z is defined from surface 132 to surface 162 and is sized to correspond the dimensions of wall interior 231. These dimensions can be, for example, those of a standardized wall construction. A standardized wall construction is formed using a wall, such as, for example, wall 200 attached to a conventional 2×4 frame. Such a frame provides a wall interior having a depth of about the greater dimension of a conventional 2×4. Distance Z—Z will include this distance plus the distance D—D of wall 200 equaling a minimum of about four inches. Thus, in such an environment, rear portion 160 of holder 100 can be sized to extend a distance not greater than that of a standardized wall construction so as to be compatible with a standardized wall construction. It should be understood that in other applications these dimensions can be greater, different or otherwise varied according to the wall, wall frame and interior of a particular environment.

Figure 3:
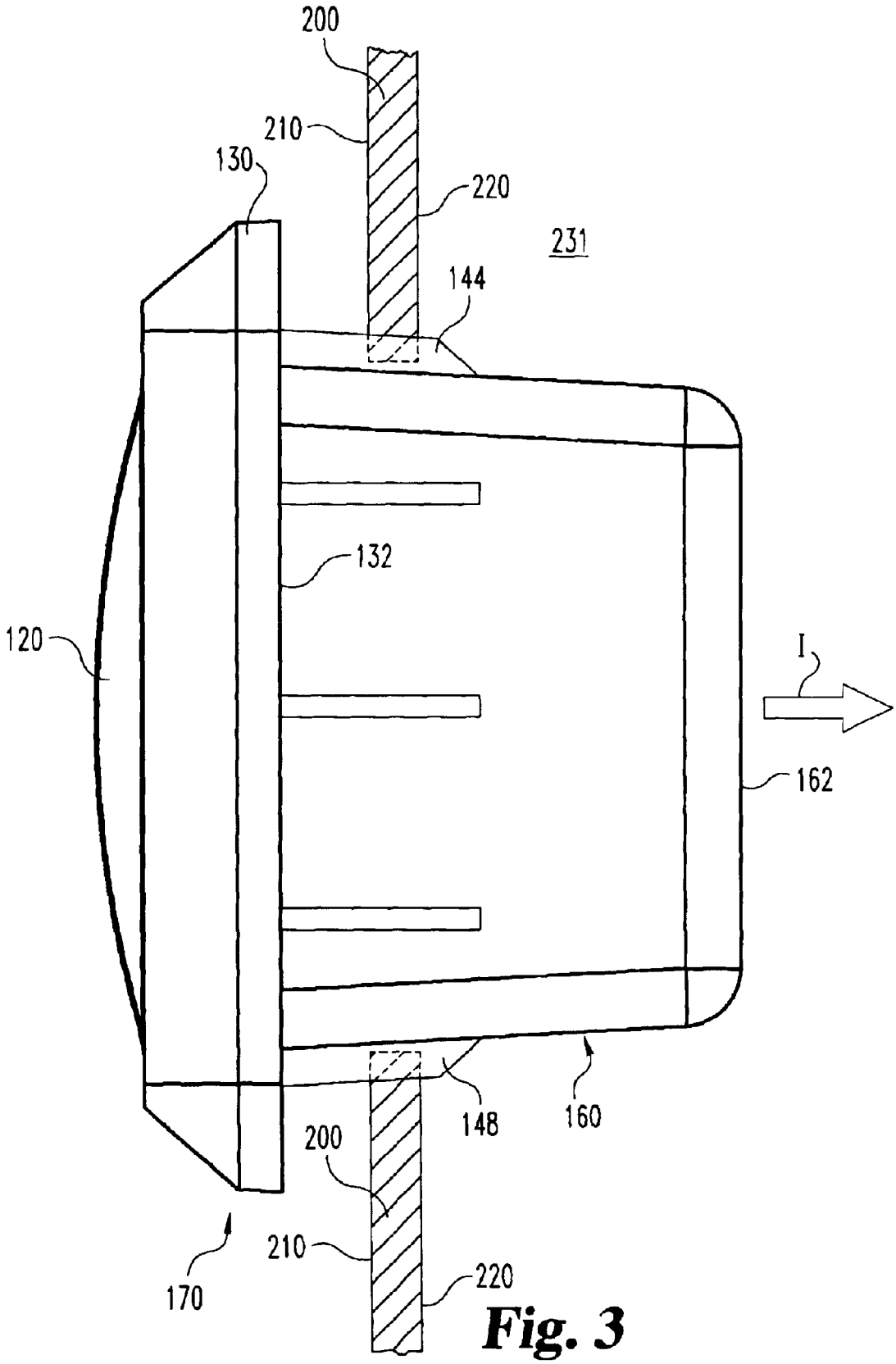
FIG. 3 is a second side view of a toilet paper dispenser according to the present invention and an environment including a wall.

FIG. 3 shows a side view of the holder 100 in an installation environment including wall 200 which is shown in cross section. In FIG. 3 the holder 100 has been further inserted in the direction indicated by arrow I. At the illustrated point during insertion rib members 144 and 148 are shown impinging into wall 200, which is shown in sectional view and with dashed portions to indicate the impingement. It will be understood that the other rib members of holder 100 also impinge into wall 200 at this point during insertion, though such is not illustrable in this view.

Figure 4:
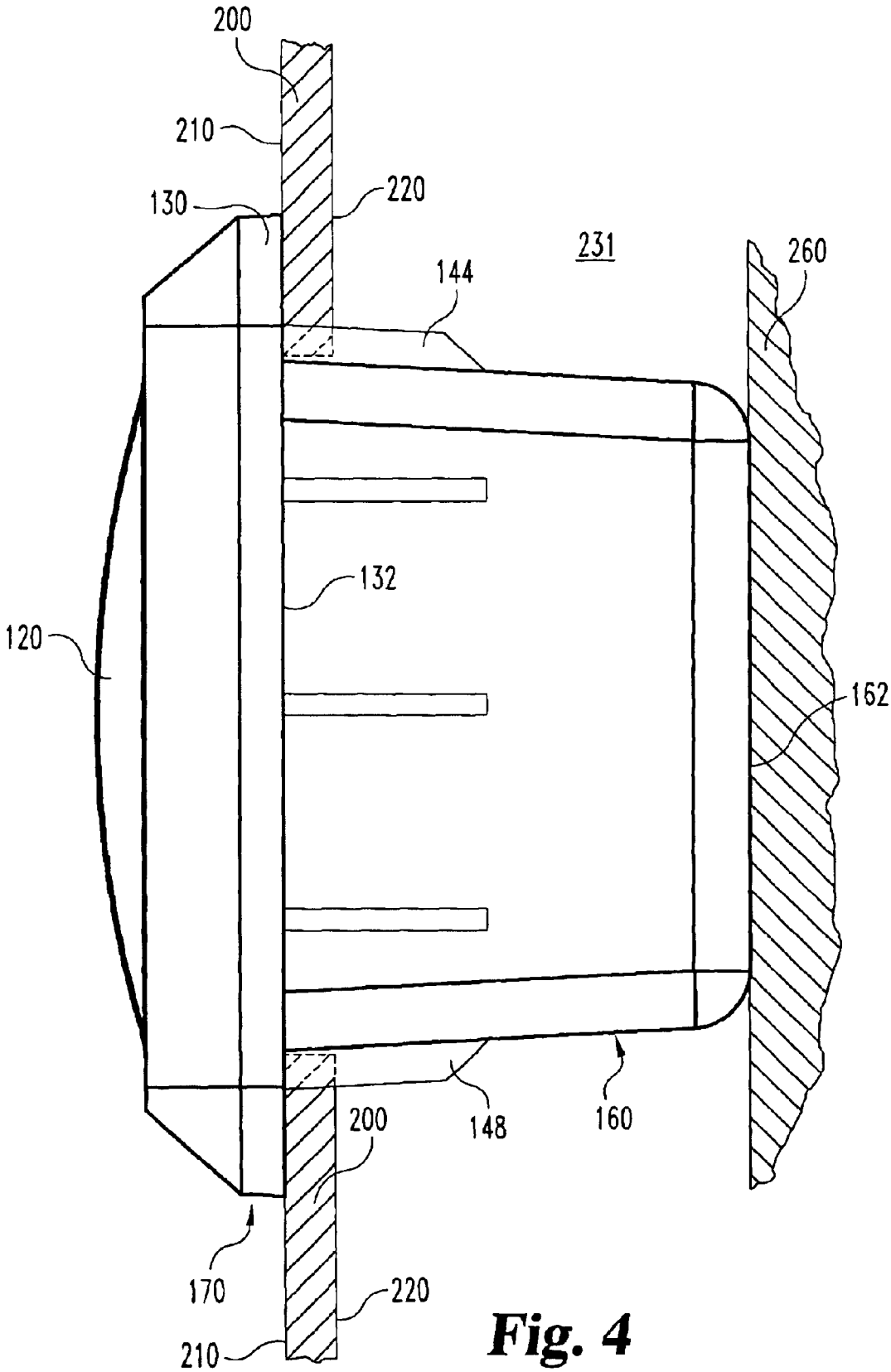
FIG. 4 is a third side view of a toilet paper dispenser according to the present invention and an environment including a wall.

FIG. 4 shows a side view of the holder 100 in an installation environment including wall 200 which is shown in cross section. In FIG. 4 the holder 100 has been substantially fully inserted to achieve installation of holder 100. In this configuration surface 132 of flange 130 contacts exterior wall surface 210. Members 144 and 148 are shown further impinging into wall 200. It will be understood that other members can also similarly impinge into wall 200, though such contact is not illustrable in this view.

FIG. 4 shows obstructing element 260 which is an environmental component of the wall construction including wall 200. Obstruction 260 can be the same or similar to wall 200 or can be any other structure found in a building, such as a concrete wall, exterior wall, or bearing wall to name but a few. Surface 162 has advanced toward obstruction 260 a distance corresponding to the dimensions of interior 231. Surface 162 may contact obstruction 260 as shown or may be separated therefrom. It is further contemplated that surface 162 may be glued to obstruction 260 using glue or other adhesive compound.

Figure 5:
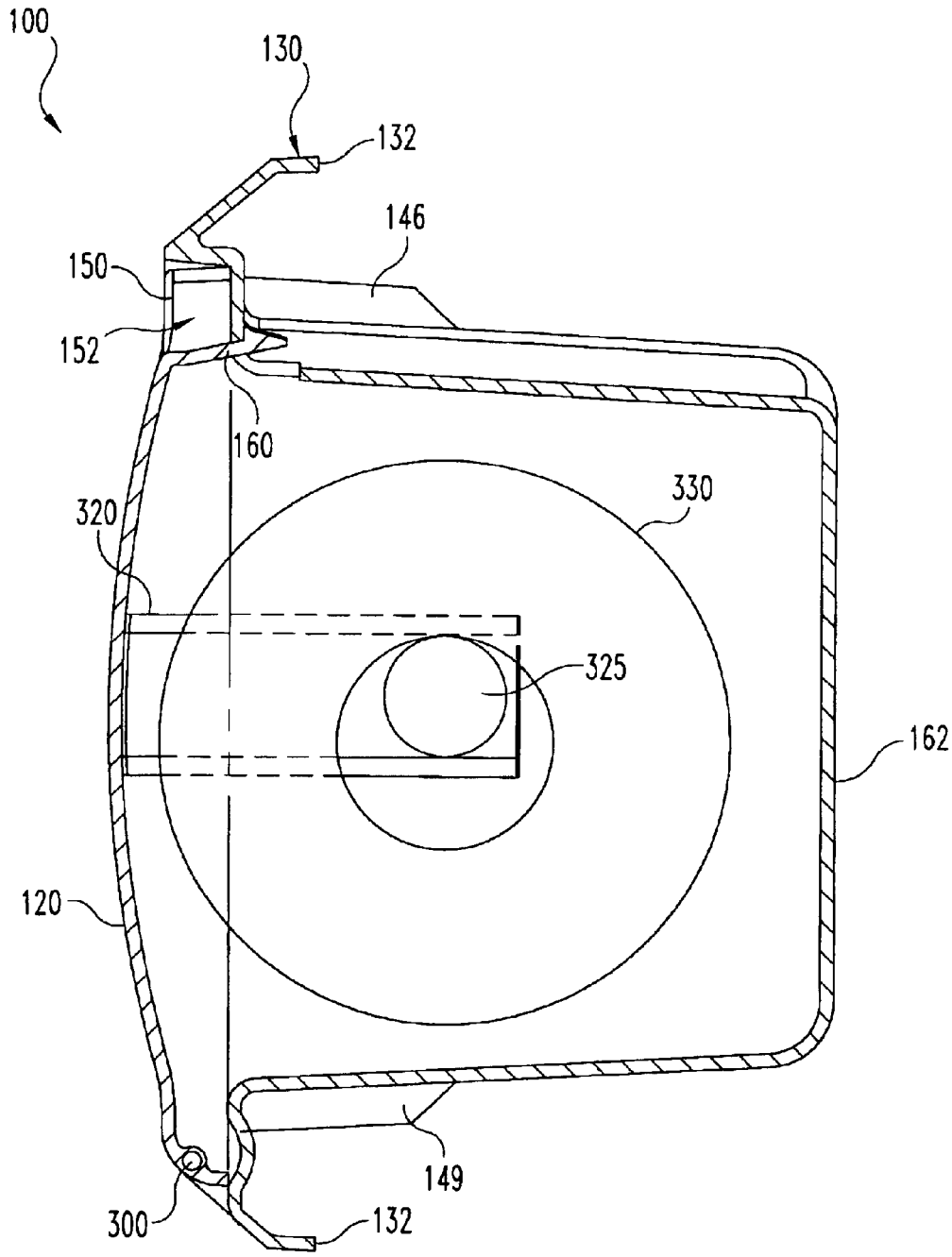
FIG. 5 is a first sectional side view of a toilet paper dispenser according to the present invention.

FIG. 5 shows a side sectional view of holder 100 taken along the line A—A of FIG. 1. FIG. 5 shows door 120 in a closed position with latch 160 engaged to holder 100. Latch 160 can be released to permit door 120 to move. This can be accomplished through applying force upon latch 160 from inside opening 152.

In FIG. 5 moveable member 149 is visible and has attributes similar to the other members as discussed above.

Furthermore, mounting fixture 320 is shown attached to door 120. Fixture 320 has received and holds toilet paper roll 330. Door 120 is in the closed position and fixture 320 and roll 330 are contained in holder 100. In this configuration roll 330 is protected by holder 100. To allow door 120 to move, post hinge 300 is provided. Hinge 300 is illustrated without hatching to convey that it need not be in the plane of line A—A of FIG. 1. Hinge 300 extends inward from the extremity of door 120 in the direction substantially normal to page of FIG. 5. Hinge 300 is rotatably received in holder 100 to permit movement of the door. Though not illustrable in the present view, a complimentary post hinge is provided and extends from the opposite extremity of door 120 in the opposite direction as hinge 300.

Figure 6:
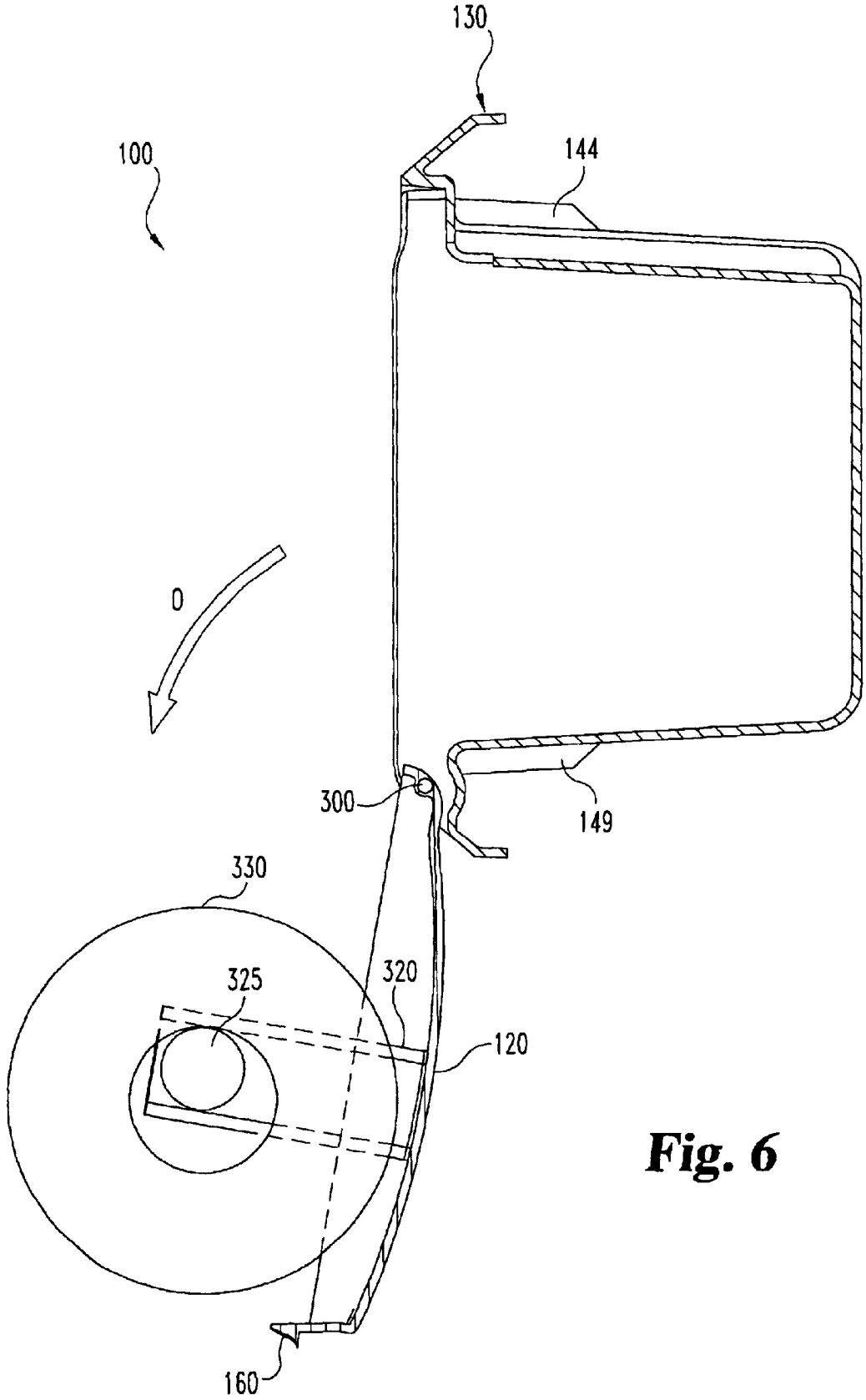
FIG. 6 is a second sectional side view of a toilet paper dispenser according to the present invention.

FIG. 6 shows a side sectional view of holder 100 taken along the line A—A of FIG. 1. Door 120 has been opened in the direction of arrow O. This is accomplished by rotation of hinge 300. Such movement is effective to transport mounting 320 and roll 330 to the exterior of holder 100. In FIG. 6 such transportation is illustrated as having progressed to a nearly 180 degrees out of phase with the closed position. Furthermore, in a completely open configuration door 120, roll 330 and mounting 320 can assume a configuration resulting in a full 180 degrees or greater of rotation relative to the configuration shown in FIG. 2. Naturally, a full range of positions intermediate the extremes is contemplated and the movement of door 120 progresses. In this manner, complete access to roll 330 is provided.

While the invention has been illustrated and described in detail in the drawings and description herein, the same is to be considered as illustrative and not restrictive in character, it being understood that only selected embodiments have been shown and described and that all equivalents, changes, and modifications that come within the spirit of the inventions as defined herein or by the following claims are desired to be protected.

I claim:

1. A toilet paper dispenser comprising:

a dispenser body having an opening;

a door connected to the body to selectably open and close the opening;

a toilet paper roll holder connected to the door, the holder extending into the dispenser when the door closes the opening;

a flange portion extending from the body; and rib means for cutting into a wall as the body is advanced into a hole in the wall.

2. The dispenser of claim 1 wherein a hinge connects the door and the body; and further comprising:

a recess formed in the dispenser;

a latch disposed within the recess, the latch engageable with the dispenser to secure the door in a position substantially covering the opening, the latch positioned to be accessible from within the recess.

3. The dispenser of claim 1 wherein the flange and the body comprise a unitary piece.

4. The dispenser of claim 1 wherein upon the flange member contacting the outside surface of the wall the flange member extends out from the outside surface of the wall a distance of at least about 1.1 inches.

5. The dispenser of claim 1 wherein the body and the rib means comprise a unitary piece.

6. The dispenser of claim 1 wherein the rib means extends from the body in the direction of the flange a distance not greater than distance of the flange.

7. The dispenser of claim 1 wherein the dispenser further comprises means for maintaining the holder in the hole in the wall and means for transporting the roll holder in and out of the dispenser.

8. The dispenser of claim 1 further comprising a plurality of rib means for cutting into a wall, and wherein the dispenser body further comprises a top surface a bottom surface a first side surface and a second side surface, said plurality of rib means disposed about the dispenser body such that at least a first one of the plurality of rib means extends from a top surface of the dispenser body, at least a second one of the plurality of rib means extends from a bottom surface of the dispenser body, at least a third one of the plurality of rib means extends from the first side surface, and at least a fourth one of the plurality of rib means extends from the second side surface.

9. A toilet paper dispenser comprising:

a container adapted to receive a roll of toilet paper, the container having an opening, a cover connected to the container to open and close about the opening, a first diameter portion, and a second diameter portion having a greater diameter than the first diameter portion;

a fixture connected to the cover, the fixture adapted to receive a roll of toilet paper;

a plurality of rib members connected to the first diameter portion, the members impinging into the wall upon the first diameter portion being inserted into an opening in a wall, the dispenser extending into the wall a maximum distance not more than about four inches, upon the second diameter portion contacting the exterior surface of the wall.

10. The dispenser of claim 9 wherein, upon the toilet paper roll being received by the fixture the toilet paper is contained in the container when the cover is closed and moved out of the container when the cover is open.

11. The dispenser of claim 9 wherein the second diameter portion comprises at least one flange surface.

12. The dispenser of claim 11 wherein the flange surface comprises an extremity of the second diameter portion.

13. The dispenser of claim 9 wherein a portion of the cover is curved outward from the opening when the cover closes about the opening.

14. The dispenser of claim 9 wherein the fixture extends into the wall a distance not greater than that of the interior of a standardized wall construction.

15. The toilet paper dispenser of claim 9 wherein the plurality of rib members comprise rib means for impinging into the wall.

16. The toilet paper dispenser of claim 15 further comprising:

a recess formed in the dispenser;

a latch disposed within the recess, the latch engageable with the dispenser to secure the cover in a position substantially covering the opening, the latch positioned to be accessible from within the recess.

17. A toilet paper dispenser comprising:

a container including an opening, a front portion and a rear portion, the rear portion having a lesser circumference than the front portion sufficient to allow the rear portion to be inserted into a hole in a wall but prevent the front portion being inserted into the hole;

a door positioned to cover the opening in a closed position and displaceable to travel outward from the opening; and a toilet paper roll mounting member connected to the door, the mounting member adapted to receive a roll of toilet paper, a plurality of rib means for cutting into a wall as the rear portion is inserted into the hole in a wall;

wherein, the rear portion extends from the front portion to a terminus over a distance not greater than that of a standardized wall construction.

18. The toilet paper dispenser of claim 17 further comprising a plurality of retaining members extending from the container, the members positioned such that when the rear portion is inserted into the hole in the wall and the front portion contacts the exterior surface of the wall the members impinge into the wall to maintain the dispenser in position relative to the wall.

19. The toilet paper dispenser of claim 18 wherein the front portion comprises a flange.

20. The toilet paper dispenser of claim 18 wherein the door is hinged to the dispenser.

21. The toiler paper dispenser of claim 18 wherein when the mounting member receives a roll of toilet paper and the door is in the closed position the toilet paper extends from a position exterior to the wall to a position interior to the wall.

22. The toilet paper dispenser of claim 17 further comprising:

a recess formed in the dispenser;

a latch disposed within the recess, the latch engageable with the dispenser to secure the door in a position substantially covering the opening, the latch positioned to be accessible from within the recess.

* * * * *